US010815996B2

(12) United States Patent
Klaus et al.

(10) Patent No.: US 10,815,996 B2
(45) Date of Patent: Oct. 27, 2020

(54) COMPRESSOR AND METHOD FOR CONTROLLING THE ROTATIONAL SPEED THEREOF

(71) Applicant: GARDNER DENVER DEUTSCHLAND GMBH, Bad Neustadt (DE)

(72) Inventors: Frank Georg Klaus, Zell-Barl (DE); Norbert Rheinländer, Gemünden (DE)

(73) Assignee: GARDNER DENVER DEUTSCHLAND GMBH, Bad Neustadt (DE)

( * ) Notice: Subject to any disclaimer, the term of this patent is extended or adjusted under 35 U.S.C. 154(b) by 257 days.

(21) Appl. No.: 15/742,111

(22) PCT Filed: Jul. 12, 2016

(86) PCT No.: PCT/EP2016/066469
§ 371 (c)(1),
(2) Date: Jan. 5, 2018

(87) PCT Pub. No.: WO2017/009307
PCT Pub. Date: Jan. 19, 2017

(65) Prior Publication Data

US 2018/0202443 A1 Jul. 19, 2018

(30) Foreign Application Priority Data

Jul. 13, 2015 (DE) ..... 10 2015 111 287

(51) Int. Cl.
*F04C 28/08* (2006.01)
*F04C 18/16* (2006.01)
*F04C 29/02* (2006.01)

(52) U.S. Cl.
CPC ..... *F04C 28/08* (2013.01); *F04C 18/16* (2013.01); *F04C 29/026* (2013.01)

(58) Field of Classification Search
CPC ..... F04C 28/08; F04D 27/0261; F04B 2203/0209
See application file for complete search history.

(56) References Cited

U.S. PATENT DOCUMENTS

RE30,994 E * 7/1982 Shaw ..... F01C 21/02 417/366
4,736,143 A * 4/1988 Nakamura ..... F04C 18/3564 318/432
4,992,715 A * 2/1991 Nakamura ..... G05D 17/02 318/649
6,216,474 B1 4/2001 Sishtla
6,461,112 B1 10/2002 Ohta et al.
6,860,730 B2 3/2005 Leppanen
2001/0046443 A1 11/2001 Van De Putte
2004/0096333 A1 5/2004 Nichol et al.
2005/0214128 A1 9/2005 Moens
2009/0308086 A1 * 12/2009 Lifson ..... F04C 18/0215 62/115
2010/0040487 A1 2/2010 Daniels et al.
2012/0315151 A1 12/2012 Hamdan
2016/0245273 A1 8/2016 Wagner

FOREIGN PATENT DOCUMENTS

CN 1678833 A 10/2005
CN 102840136 A 12/2012
DE 102013111218 A1 4/2015
WO 2007019651 A2 2/2007
WO 2015082432 A1 6/2015

OTHER PUBLICATIONS

International Search Report and Written Opinion for Application No. PCT/EP2016/066469 dated Oct. 10, 2016 (7 pages.).
Chinese Patent Office Action for Application No. 201680041450.2 dated Jan. 11, 2019 (6 pages, statement of relevance included).

* cited by examiner

*Primary Examiner* — Patrick Hamo
(74) *Attorney, Agent, or Firm* — Michael Best & Friedrich LLP

(57) ABSTRACT

The present invention relates primarily to a method for controlling the rotational rate of a compressor, which controls, in particular, the rotational rate of a rotating compression element of the compressor. The invention furthermore relates to a compressor, e.g. a compressor for generating pressurized air. The compressor is to be operated at a rotational rate, when in operation, with a mean value that is at least as high as a minimum mean value, in order to ensure the functionality of the compressor. According to the method, a temporally variable target rotational rate of the compressor that is necessary for obtaining a temporally variable output performance from a compressor is determined. In accordance with the invention, a lower rotational rate limit is raised if the temporal mean of the variable target rotational rate is lower than the minimal mean value for the rotational rate of the compressor.

11 Claims, No Drawings

COMPRESSOR AND METHOD FOR CONTROLLING THE ROTATIONAL SPEED THEREOF

CROSS-REFERENCE TO RELATED APPLICATIONS

This is a U.S. national stage entry of International Patent Application No. PCT/EP2016/066469, filed on Jul. 12, 2016, which claims priority to German Patent Application No. 10 2015 111 287.6, filed on Jul. 13, 2015, the entire contents of all of which are fully incorporated herein by reference.

The present invention relates primarily to a method for controlling the rotational rate of a compressor, through which, in particular, the rotational rate of a rotating compression element of the compressor is controlled. The invention also relates to a compressor, e.g. a compressor for generating pressurized air.

DE 603 13 320 T2 describes a method for relieving a screw compressor, with which air is removed from the screw compressor when the air intake is closed.

DE 10 2013 111 218 A1 teaches of an electronic control device for a component for generating pressurized air. The control device refers to models for the structure and behavior of the components for generating pressurized air.

A method for controlling the operation of a screw compressor device is known from DE 100 47 940 A1, in which the rotational frequency of a motor in the screw compressor device is regulated.

DE 601 18 088 T2 describes a method for controlling a compressor unit, in which the rotational rate of a lubricated compression element is regulated.

DE 601 15 671 T2 teaches of an oil-injected screw compressor with a modifiable rotational rate, controlled on the basis of a measurement of the speed and the rotational torque of a compressor drive.

The object of the present invention, based on the prior art, is to ensure that a compressor, the output power of which can be modified by varying its rotational rate, functions reliably over time, and at the same time facilitates an efficient operation of the compressor.

This object is achieved by a method in accordance with the accompanying claim 1, and by a compressor in accordance with the accompanying coordinate independent claim 10.

The method according to the invention is used for controlling the rotational rate of a compressor. The compressor is preferably a compressor, used in particular for generating pressurized air. The operation of the compressor is characterized by a rotational rate, in particular the rotational rate of a rotating compression element of the compressor. In order to ensure that the compressor functions reliably over time, the compressor is to be operated at a rotational rate with a mean value that is at least as high as a minimum mean value. The rotational rate can vary over time. The mean value is an average value of the temporally variable rotational rate. The reliable functioning of the compressor is only ensured when its average rotational rate over a long period of time is at least as high as the minimum mean value. As a result, individual procedures in the compressor, such as oil separation, or lubrication, can only take place to a sufficient extent if the mean rotational rate of the compressor over a long period of time is at least as high as the minimum mean value.

In one of the steps in the method according to the invention, a target rotational rate of the compressor that is necessary for obtaining an output performance is determined. The output performance that is to be obtained by the compressor is determined in particular by another process, or by an operator of the compressor, and can vary over time. Accordingly, the target rotational rate can also vary over time.

A temporal mean of the temporally variable target rotational rate is determined in a further step of the method according to the invention. The temporal mean is the average target rotational rate during a monitored time period.

In accordance with the invention, a lower rotational rate limit of the compressor is raised if the temporal mean of the variable target rotational rate is lower than the minimum mean value of the compressor rotational rate. The lower rotational rate limit is a value, below which the rotational rate of the compressor may not fall. In accordance with the invention, the compressor is operated at a target rotational rate, wherein, however, the rotational rate does not fall below the lower rotational rate limit. If the temporal mean of the variable target rotational rate is lower than the minimum mean value for a long period of time, the compressor will not function reliably, because sufficient oil separation can no longer take place, resulting in excessive oil content in the pressurized air. By raising the lower rotational rate limit, the average rotational rate of the compressor is increased, thus ensuring a reliable functioning of the compressor over time.

One particular advantage of the method according to the invention is that the compressor can be operated efficiently, because it can also be operated at lower rotational rates that are lower than a corresponding statistical lower rotational rate limit if the performance demand is lower.

In preferred embodiments of the method according to the invention, the temporal mean of the temporally variable target rotational rate is determined over the course of a monitoring interval. The temporal mean of the target rotational rate thus represents the average target rotational rate during the monitoring interval.

In preferred embodiments of the method according to the invention, the lower rotational rate limit is raised after the monitoring interval if the temporal mean of the variable target rotational rate is lower than the minimum mean value of the rotational rate of the compressor. The lower rotational rate limit is particularly preferably raised immediately after the monitoring interval if the temporal mean of the variable target rotational rate is lower than the minimum mean value of the rotational rate of the compressor. As a result, it is ensured that the mean rotational rate of the compressor increases immediately.

In preferred embodiments of the method according to the invention, the temporal course of the variable target rotational rate of the compressor is recorded during the monitoring interval. Thus, not only the mean value of the target rotational rate, but also the temporal course of the target rotational rate are obtained.

In preferred embodiments of the method according to the invention, the lower rotational rate limit is raised after the monitoring interval enough that the recorded temporal course of the variable target rotational rate exhibits a temporal mean over the monitoring interval that is at least as high, and particularly preferably is exactly as high, as the minimum mean value of the rotational rate of the compressor. It is assumed with this embodiment that the compressor is operated in the subsequent monitoring interval at the same rate as the output performance that is to be obtained. If this is the case, the mean value for the rotational rate of the compressor in this next monitoring interval is at least as high, or exactly the same, as the minimum mean value for the rotational rate. Consequently, the functioning of the compressor is ensured, and the rotational rate of the compressor is significantly lowered when low output performances are to be obtained, resulting in an efficient operation of the compressor. In most cases, in which the compressor is frequently operated at the same rate as the output performance that is to be obtained, the compressor rotational rate is lowered when the intended output performance is low, until the mean value of the compressor rotational rate reaches the minimum mean value.

The method according to the invention preferably runs periodically, wherein the periods each correspond to the length of monitoring period. In each of the periods, the temporally variable target rotational rate of the compressor is determined, the temporal mean of the variable target rotational rate is determined, and the lower rotational rate limit is raised, if the temporal mean of the variable target rotational rate is lower than the minimum mean value of the rotational rate of the compressor.

In preferred embodiments of the method according to the invention, a monitoring also takes place to determine how often the temporally variable target rotational rate alternates between an upper target rotational rate and a lower target rotational rate. The upper target rotational rate is preferably formed by the maximum rotational rate of the compressor, and corresponds to a full-load operation. The upper target rotational rate is alternatively 80% of the maximum rotational rate of the compressor. The lower rotational rate is preferably formed by an idling speed. Alternatively, the lower target rotational rate is 50% of the maximum rotational rate of the compressor. In the monitoring described above, the number of times that the variable target rotational rate alternates between the upper target rotational rate and the lower target rotational rate is counted, wherein only the changes from the upper target rotational rate to the lower target rotational rate, or only the changes from the lower target rotational rate to the upper target rotational rate need to be counted. In this embodiment, an upper rotational rate limit is lowered if the alternating between the lower target rotational rate and the upper target rotational rate exceeds a predefined maximum. The reduced upper rotational rate limit is lower than the upper target rotational rate thereby. The compressor is operated according to the invention at the target rotational rate, wherein the upper rotational rate, however, is not exceeded. The reduction of the upper rotational rate limit results in the compressor alternating less frequently between a very high rotational rate, specifically the maximum rotational rate, and a low rotational rate, specifically the idling speed. Insofar as the output performance of the compressor that is to be obtained frequently alternates between a high output and a low output, this likewise results in a frequent alternating between the upper target rotational rate and the lower target rotational rate. By reducing the upper rotational rate limit, the rotational rate of the compressor does not always vary to the same extent, but instead, fluctuates within a mean range. This reduces the wear to the compressor. The maximum number of changes is pre-defined such that the compressor is operated efficiently.

The monitoring described above, of how often the variable target rotational rate alternates between the upper target rotational rate and the lower target rotational rate, preferably takes place over the course of the monitoring interval. The reduction described above, of the upper rotational rate limit, preferably takes place immediately after the monitoring interval, if the number of changes between the lower target rotational rate and the upper target rotational rate exceeds a predefined maximum.

The compressor is preferably configured for compressing a medium, such that a compression of the medium takes place in accordance with the invention. The medium is preferably formed by a gas. The gas is preferably formed by air, such that the compressor is configured to generate pressurized air discharged by the compressor. The gas can also be carbon dioxide or oxygen, for example. The medium that is to be pressurized can also be an aerosol.

The compression of the medium takes place inside the compressor, preferably with intermeshing screw rotors forming the compression element. The rotational rate of the compressor described above represents the rotational rate of the screw rotors. The compressor can also be formed with other types of compression elements, e.g. gears or pistons.

The compressor is preferably operated with a fluid serving as a lubricant and/or with a fluid serving as a coolant. The fluid is preferably formed by oil and/or water.

A separation of the compressed air from the fluid preferably takes place in the compressor through the use of a separator. The raising of the lower rotational rate limit takes place in accordance with the invention if the temporal mean of the variable target rotational rate is lower than the minimum mean value for the rotational rate of the compressor, preferably in order to ensure the reliable separation of the compressed gas from the fluid with the separator, i.e. in order to reliably ensure that the separator functions reliably over the course of time.

The temporally variable output performance that is to be obtained is preferably represented by a volume flow of the medium compressed by the compressor. The rotational rate of the compressor and the volume flow are directly dependent on one another. The variable output performance that is to be obtained can also be represented by a pressure.

The compressor according to the invention is used to compress a medium. It comprises at least one rotating compression element, and a motor for driving the at least one rotating compression element. The compressor is to be operated at a rotational rate that has a mean value that is at least as high as a minimum value for ensuring that the compressor functions. The compressor also comprises a rotational rate control, which is configured for executing the method according to the invention. The rotational rate control is preferably configured for executing preferred embodiments of the method according to the invention. Moreover, the compressor according to the invention also comprises those features that are described in conjunction with the method according to the invention.

The compressor is preferably formed by a screw compressor, comprising two rotating compression elements formed by intermeshing screw rotors.

The compressor is preferably configured to be operated with a fluid serving as a lubricant and/or a fluid serving as a coolant. The fluid is preferably formed by oil and/or water.

The compressor preferably comprises a separator for separating the fluid from the compressed gas. The separator preferably comprises a pre-separator and/or a fine separator.

The control is preferably formed by a microcontroller, which implements individual control steps and generates control signals.

Further advantages, details, and developments of the invention can be derived from the following description of a preferred embodiment of the invention.

A preferred embodiment of the invention is formed by an oil-injection screw compressor for pressurizing air. The compressed air is discharged as pressurized air.

The screw compressor comprises a compressor stage, in which oil is injected for lubricating and cooling purposes, and separated from the pressurized air at a pressure side of the screw compressor after the air is pressurized. The screw compressor comprises a pre-separator for this, with which the pressurized air is separated from the oil, wherein the separated oil is circulated back to an intake side of the screw compressor.

The pre-separated pressurized air also flows through a fine separator of the screw compressor in order to purify the pressurized air of any remaining fine particles of oil. This pressurized air, purified by the fine separator, contains only a small amount of oil particles, referred to as residual fluid content. The residual fluid content is approximately 1 to 5 mg of fluid per cubic meter of intake volume flow.

The fine separator only functions adequately within a limited volume flow range. If the volume flow does not remain within this volume flow range, the residual fluid content increases significantly within a short period of time. With volume flows that are greater than the maximum volume flow for the respective fine separator that is used, dictated by the model and size thereof, oil particles are able to pass through the fine separator. With volume flows that are lower than the minimum volume flow for the respective fine separator that is used, the separation is impaired by the lack of contact of the oil with the fine separator.

The fine separator is configured such that the volume flow of the screw compressor at a maximum rotational rate of the screw compressor is coordinated to a maximum volume flow for the fine separator in order to ensure separation of the oil.

The volume flow of the screw compressor is lower than the minimum volume flow of the fine separator when the screw compressor rotates at a minimum rate. If the screw compressor is operated for long periods of time at its minimum rotational rate, this leads to an increased residual fluid content, such that the functioning of the screw compressor becomes impaired, or the desired purity of the discharged medium (e.g. pressurized air) does not meet demands placed thereon, possibly resulting in damage to downstream system components supplied therewith.

With the screw compressor according to the invention, a rotational rate consumption profile is created automatically via an algorithm in a rotational rate control unit of the screw compressor. The following is an example of this rotational rate consumption profile:

25% rotational rate-70% of the operating time
50% rotational rate-15% of the operating time
75% rotational rate-10% of the operating time
100% rotational rate-5% of the operating time The amount of pressurized air to be delivered by the screw compressor can be selected and modified by an operator. The pressurized air quantity to be delivered by the screw compressor represents its output performance, which may vary over time. The rotational rate of the screw compressor and the pressurized air delivery quantity, i.e. the volume flow of the compressor, are directly dependent on one another.

Depending on the respective temporal course of the pressurized air delivery quantity, the rotational rate limits, i.e. a lower rotational rate limit and an upper rotational rate limit, are automatically adjusted on the basis of this frequency distribution. The rotational rate of the screw compressor subsequently lies between the lower and upper rotational rate limits.

If the screw compressor is primarily operated at its minimum rotational rate for most of the time it is in operation, the residual oil content increases. In accordance with the invention, however, the lower rotational rate limit is raised, such that the thus larger volume flow of the screw compressor results in the fine separator retaining is functionality over the course of time. In this manner, it is ensured that the residual fluid content does not increase to an undesired level.

Furthermore, the number of changes from a load state to an idling state is determined according to the invention. If this number increases above a predefined maximum number, the upper rotational rate limit is reduced, such that the maximum volume flow is decreased, resulting in the screw compressor alternating less frequently between a load state and an idling state. A more frequent alternating between the load state and the idling state, which is prevented in accordance with the invention, would result in a lower energy efficiency due to pressure release procedures. This is relevant in particular for those compressors in which the targeted volume flow is substantially lower than the maximum volume flow of the compressor. A constant alternating of the compressor between the load state and the idling state is prevented in accordance with the invention, thus increasing the service life of the compressor according to the invention.

The rotational rate control unit creates new consumption profiles at regular intervals, in order to readjust the rotational rate limits when the demand for pressurized air changes.

What is claimed is:

1. A method for controlling the rotational rate of a compressor, which is to be operated at a rotational rate when in operation with a mean value that is at least as high as a minimum mean value for ensuring the functionality of the compressor, the method comprising:

determining a temporally variable target rotational rate of the compressor that corresponds to a desired compressor output performance that varies over time;

determining a temporal mean of the temporally variable target rotational rate; and in response to the temporal mean of the variable target rotational rate being lower than the minimum mean value for the rotational rate of the compressor, raising a lower rotational rate limit.

2. The method according to claim 1, characterized in that the temporal mean of the temporally variable target rotational rate is determined over the course of a monitoring interval.

3. The method according to claim 2, characterized in that the lower rotational rate limit is raised after the monitoring interval if the temporal mean of the variable target rotational rate is lower than the minimum mean value for the rotational rate of the compressor.

4. The method according to claim 2, characterized in that a temporal course of the temporally variable target rotational rate of the compressor is recorded during the monitoring interval.

5. The method according to claim 4, characterized in that the lower rotational rate limit is raised high enough after the monitoring interval that a temporal mean of the recorded temporal course of the variable target rotational rate over the course of the monitoring interval, when limited by the raised lower rotational rate limit, is as high as the minimum mean value for rotational rate of the compressor.

6. The method according to claim 1, characterized in that a gas is compressed with the compressor, wherein a fluid is used as a lubricant and/or as a coolant, which is separated from the compressed gas with a separator.

7. The method according to claim 6, characterized in that the lower rotational rate limit is raised if the temporal mean of the variable target rotational rate is lower than the minimum mean value for the rotational rate of the compressor, in order to ensure that the fluid is separated out of the compressed gas.

8. The method according to claim 1, characterized in that the temporally variable output performance that is to be obtained is represented by a volume flow of a medium that is to be pressurized by the compressor.

9. A compressor for pressurizing a medium, comprising at least one rotating compression element and one motor for driving the at least one rotating compression element, wherein the compressor is to be operated at a rotational rate with a mean value that is at least as high as a minimum mean value when in operation, in order to ensure that the compressor functions reliably over time, and wherein the compressor comprises a rotational rate control unit that is configured for executing a method according to claim 1.

10. A method for controlling the rotational rate of a compressor, which is to be operated at a rotational rate when in operation with a mean value that is at least as high as a minimum mean value for ensuring the functionality of the compressor, the method comprising:

determining a temporally variable target rotational rate of the compressor that corresponds to a desired compressor output performance that varies over time;

determining a temporal mean of the temporally variable target rotational rate;

in response to the temporal mean of the variable target rotational rate being lower than the minimum mean value for the rotational rate of the compressor, raising a lower rotational rate limit;

monitoring how often the variable target rotational rate alternates between an upper target rotational rate and a lower target rotational rate; and in response to the number of changes between the lower target rotational rate and the upper target rotational rate exceeding a predefined maximum, lowering an upper rotational rate limit.

11. A system for controlling the rotational rate of a compressor, which is to be operated at a rotational rate when in operation with a mean value that is at least as high as a minimum mean value for ensuring the functionality of the compressor, the system comprising:

a compressor control unit configured to determine a temporally variable target rotational rate of the compressor that corresponds to a desired compressor output performance that varies over time;

determine a temporal mean of the temporally variable target rotational rate; and in response to the temporal mean of the variable target rotational rate being lower than the minimum mean value for the rotational rate of the compressor, raise a lower rotational rate limit.

* * * * *